United States Patent [19]

Duthweiler

[11] 4,048,808

[45] Sept. 20, 1977

[54] ICE ISLANDS AND METHOD FOR FORMING SAME

[75] Inventor: Frederick C. Duthweiler, Anchorage, Alaska

[73] Assignee: Union Oil Company of California, Brea, Calif.

[21] Appl. No.: 678,317

[22] Filed: Apr. 19, 1976

[51] Int. Cl.[2] ..... E02B 3/00; F25C 1/02

[52] U.S. Cl. ..... 61/103; 62/260

[58] Field of Search ..... 61/46, 1 R, 36 A, 1 F, 61/50, 103; 166/DIG. 1; 62/260, 259

[56] References Cited

U.S. PATENT DOCUMENTS

| | | | |
|---|---|---|---|
| 3,436,920 | 4/1969 | Blenkarn et al. | 61/46 |
| 3,654,766 | 4/1972 | Schuh | 61/50 |
| 3,660,983 | 5/1972 | Gill | 61/36 A |
| 3,750,412 | 8/1973 | Fitch et al. | 61/46 |
| 3,798,912 | 3/1974 | Best et al. | 61/1 R |
| 3,842,607 | 10/1974 | Kelseaux et al. | 61/50 |
| 3,863,456 | 2/1975 | Durning | 61/36 A |
| 3,881,318 | 5/1975 | Galloway | 61/46 |
| 3,925,991 | 12/1975 | Pocme | 61/1 R |

*Primary Examiner*—Paul R. Gilliam
*Assistant Examiner*—Alex Grosz
*Attorney, Agent, or Firm*—Richard C. Hartman; Dean Sandford

[57] ABSTRACT

An ice island for use in offshore operations in cold waters includes an operations pad and a surrounding containment barrier, the bases of which are grounded on the marine bottom. The island is constructed by accumulating ice in confined areas defined on a sheet of native ice until the mass of the accumulated ice causes the ice underlying and adjacent to the confined area to be depressed with respect to the main body of ice and be grounded on the marine bottom.

12 Claims, 9 Drawing Figures

ICE ISLANDS AND METHOD FOR FORMING SAME

BACKGROUND OF THE INVENTION

This invention relates to marine bottom supported structures for offshore work operations in cold waters and more particularly to ice islands which are grounded on a marine bottom for use as work platforms in relatively shallow waters and to the method of constructing the same.

With the increasing search for petroleum and gas deposits, considerable interest has been focused on exploration and production efforts in the arctic and antarctic regions of the world. In these areas, deposits of petroleum and gas are often found offshore in shallow waters that are ice-covered through a good portion of the year. Conventional floating platforms are not well suited for operations in these waters.

Various types of bottom-secured platforms have been suggested for use in such ice covered water, including reenforced pile-mounted raised platforms and artificial islands constructed from bottom dredgings. These structures have been successful and have demonstrated the ability to survive the summer ice breakup such as occurs in waters off the Alaskan coast. Such devices, however, are expensive to construct and do not lend themselves to use for temporary work such as exploratory drilling.

Ideally, ice itself will serve as a material for the construction of artificial islands in cold regions, especially during the winter months of the arctic and antarctic year which may extend as long as 9 or 10 months. It is known that grounded ice islands may be constructed by depositing water over existing ice to thicken it until the mass of the thickened area is such that its draft is greater than the water depth and at least a portion of the thickened area is grounded on the marine bottom. Two such devices and the method for constructing them are described in U.S. Pat. Nos. 3,750,412 (Fitch, et al.) and 3,863,456 (Durning).

Ice islands appear to be feasible for use as work platforms from which to conduct operations such as temporary exploratory drilling and, under the proper circumstances even year-round drilling. Ice islands which have been proposed to date are deficient, however, in that they do not provide for the containment of formation fluids, such as crude petroleum, in the event of accidental escape from the formation during a drilling operation. Conventional ice islands are not adapted to cope with shifting ice and the stresses imposed on the island as a result thereof even though it is understood that ice shift may occur even during the winter months.

The present invention contemplates an ice island and the method for its construction which is designed to overcome the foregoing deficiencies.

SUMMARY OF THE INVENTION

Briefly, the present invention resides in an ice island comprising an operations pad and a surrounding containment barrier. The bases of both the operations pad the containment barrier are grounded on the marine bottom and their upper surfaces are raised above the surface of the native ice. Native ice bridges the space between the operations pad and the containment barrier.

The ice island is constructed by the accumulation of new ice within confined areas corresponding in shape and plan configuration to the operations pad and the containment barrier. The confined areas are formed by the construction of dikes on the surface of the native ice. Water is deposited within the confined areas and permitted to freeze until the mass of the accumulated ice deforms the underlying native ice in and adjacent to the confined area downwardly away from the surrounding native ice until it is supported on the marine bottom. Ice accumulation is continued until the upper surfaces of the operations pad and the containment barrier are raised above the surface of the native ice. In the preferred method of construction, ice accumulation is accomplished by intermittent flooding followed by freezing of the flooded area so that the ice is built up as a series of layers.

In accordance with the present invention, the ice island thus formed is grounded on the bottom in a highly stable condition, being grounded both at the center portion by the base of the operations pad and at its outer periphery by the base of the surrounding containment barrier. The containment barrier cooperates with the upper and lower surfaces of the bridging native ice to define upper and lower containment bases which serve to trap and contain fluids which may be released from formations within the ground as a result of accident or well "kicks" or the like.

Additionally, the containment barrier presents a substantially greater surface area to shifting pack ice than the operations pad alone. Consequently, stresses imposed on the ice island by shifting pack ice are diffused over a greater area than would be the case for the operations pad alone. Moreover, should the force of the shifting pack ice exceed the strength of the containment barrier, causing it to begin to collapse inwardly, the bridging portion of the native ice serves to absorb additional stress energy imposed by the collapsing containment barrier and provides early warning of excessive stress being applied to the ice island so that adequate stress relief measures can be undertaken.

Other features of the present invention reside in the enlarging of a portion of the containment barrier so as to define an integrally formed emergency relief pad and in the insulation of the base of the operations pad from surrounding sea water by the containment barrier thereby reducing the erosion of the base of the operations pad by melting.

Other features and advantages of the present invention will become apparent from the following detailed description and the accompanying drawings.

DESCRIPTION OF THE INVENTION

Figure 1:
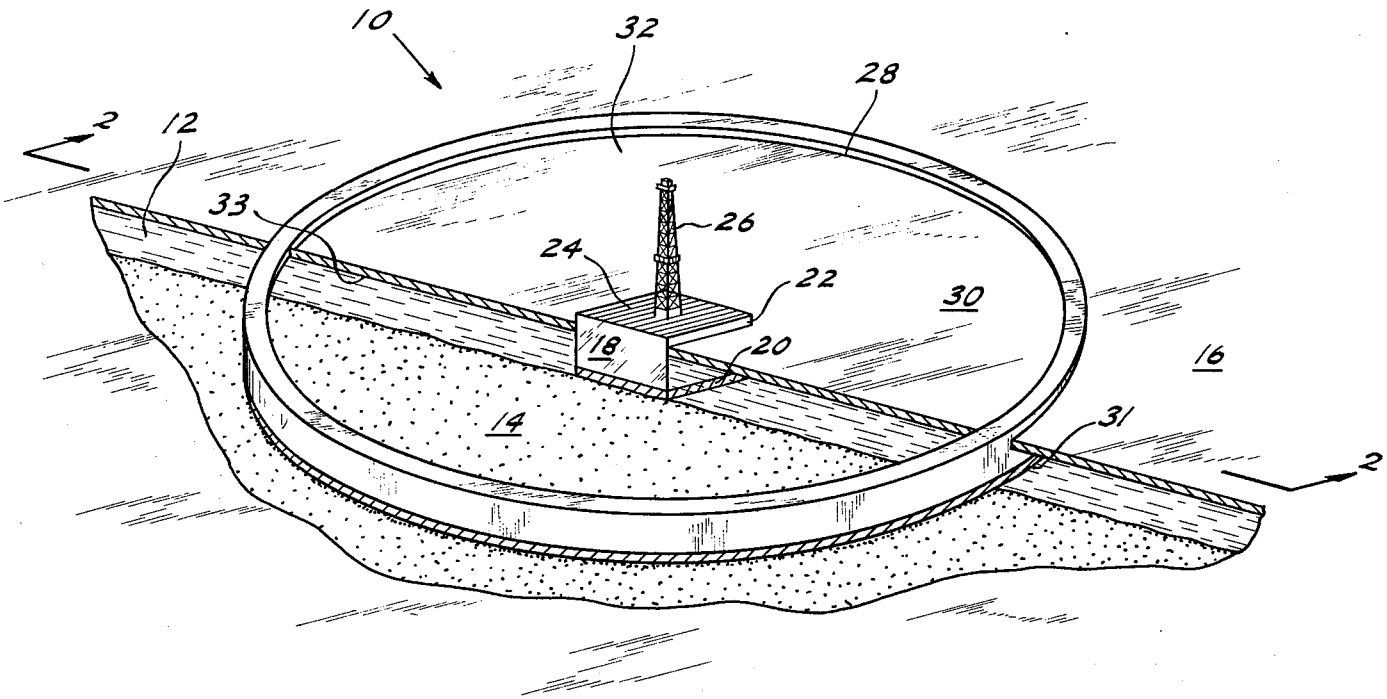
FIG. 1 is a perspective view of an ice island constructed in accordance with the invention, a portion of the existing native ice being cut away to expose the marine bottom.
Figure 2:
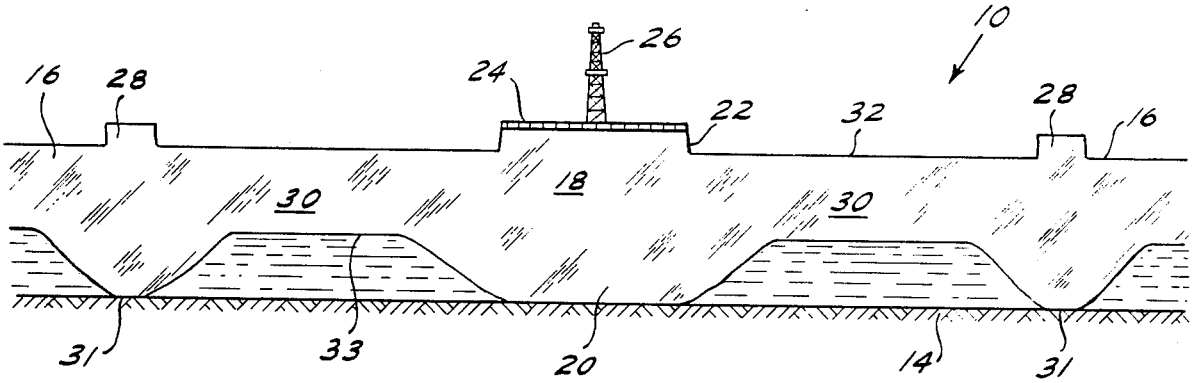
FIG. 2 is a sectional view of the ice island taken along the line 2—2 of FIG. 1.
Figure 3:
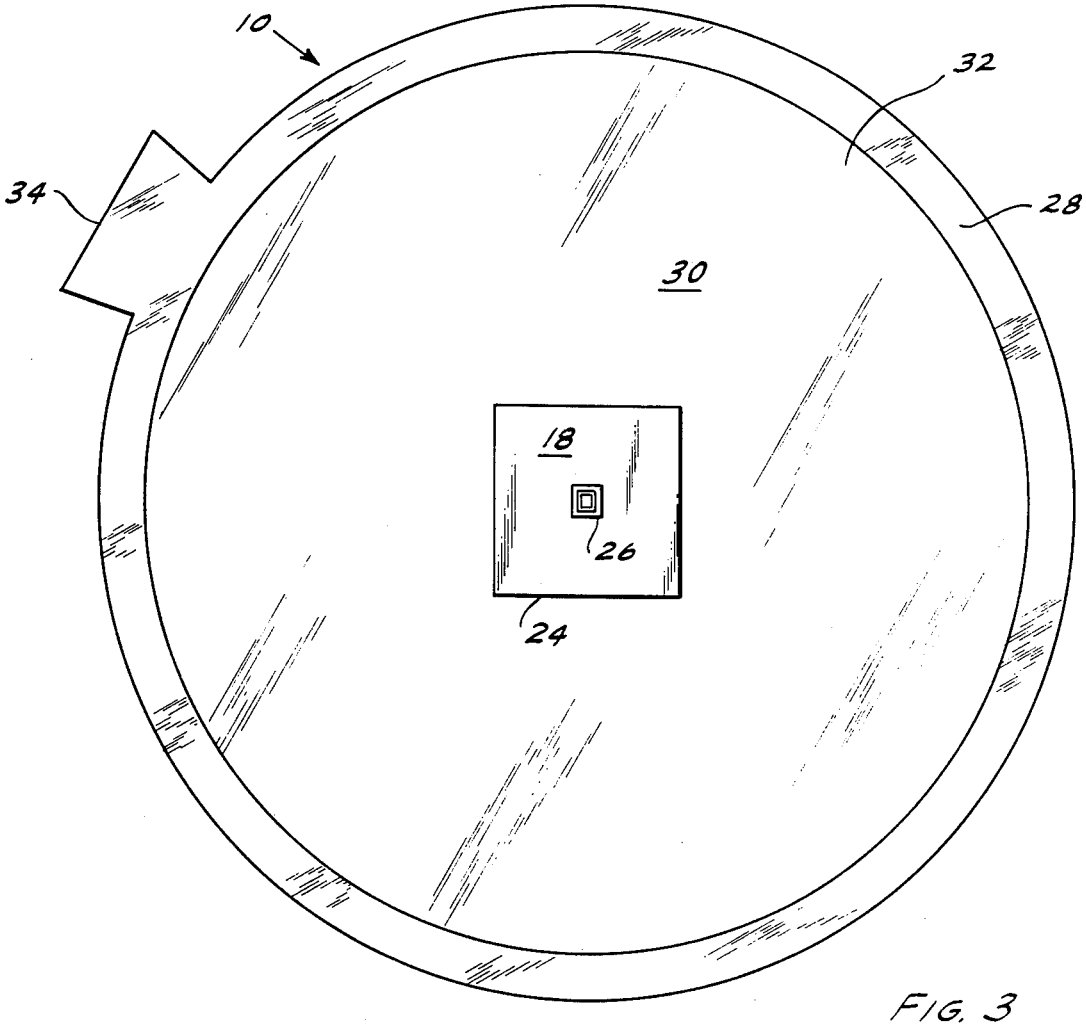
FIG. 3 is a plan view of the ice island of FIG. 1.

Referring to the drawings and to FIGS. 1, 2, and 3 in particular, an ice island, illustrated generally as 10, is grounded on the marine bottom 14 in relatively shallow, cold water over which typically a layer of native ice 16 floats. The depth of the water may range from a few feet to as much as 30 feet, although typically the water depth will be generally not greater than about 15 feet. The native ice 16, which normally ranges from about 2 feet to 9 feet in thickness depending on its location and the time of the year, may be part of a polar ice pack or may be fast ice which is normally attached to the shore. In addition, the native ice on which the island is formed may be towed or otherwise moved to the desired location.

The ice island 10 includes an operations pad 18 having its base 20 supported on the marine bottom 14, and an upper portion 22 extending above the level of the surrounding ice to form a raised work surface 24 on which operations are conducted and equipment supported, such as a drilling rig 26. Containment barrier 28 surrounds the operations pad 18 and a portion 30 of floating native ice within the confines of the containment barrier bridges the space therebetween. The containment barrier 28 is also grounded on the marine bottom 14 at its base 31 and its upper portion is extended above the level of the adjacent ice 16. The upper and lower surfaces of the bridging ice layer 30 and the containment barrier 28 define upper and lower containment basins 32 and 33 respectively, the function of which will be described in more detail hereinafter. As illustrated the operations pad 18 is generally rectangular and the containment barrier 28 is annular, however, these shapes are not critical and any convenient shape may be selected for the pad and barrier.

As is most clearly shown in FIG. 3, in one embodiment of the invention a portion of the containment barrier 28 is enlarged to define a relief pad 34 which is formed integrally with the containment barrier 28 and is grounded on the marine bottom 14. The upper surface of the relief pad is elevated above the adjacent ice. As will be seen presently, the relief pad 34 provides support for apparatus used to drill a relief well in the event of a blowout through the main well. Preferably, the relief pad 34 is located on the periphery of the containment barrier 28 so as to be oriented with respect to the operations pad 18 in the direction of the prevailing winds.

Figure 4:
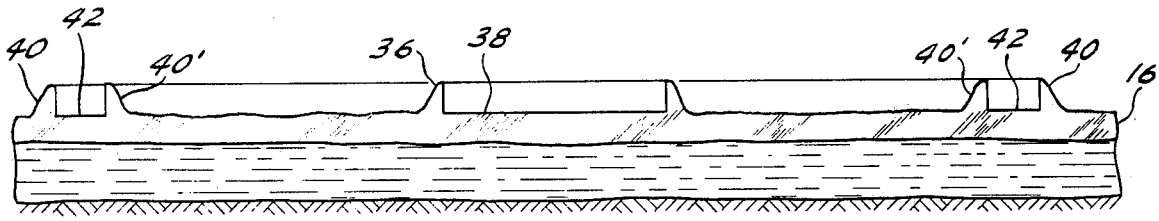
FIG. 4 is a vertical sectional view of native ice on which dikes have been constructed as a step in forming the ice island of the invention.
Figure 5:
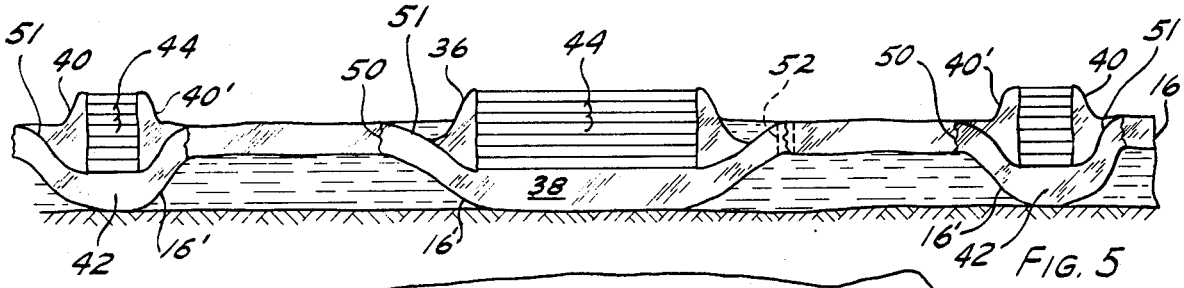
FIG. 5 is a vertical sectional view similar to FIG. 4 after layers of ice have been accumulated during the formation of the ice island of this invention.
Figure 6:
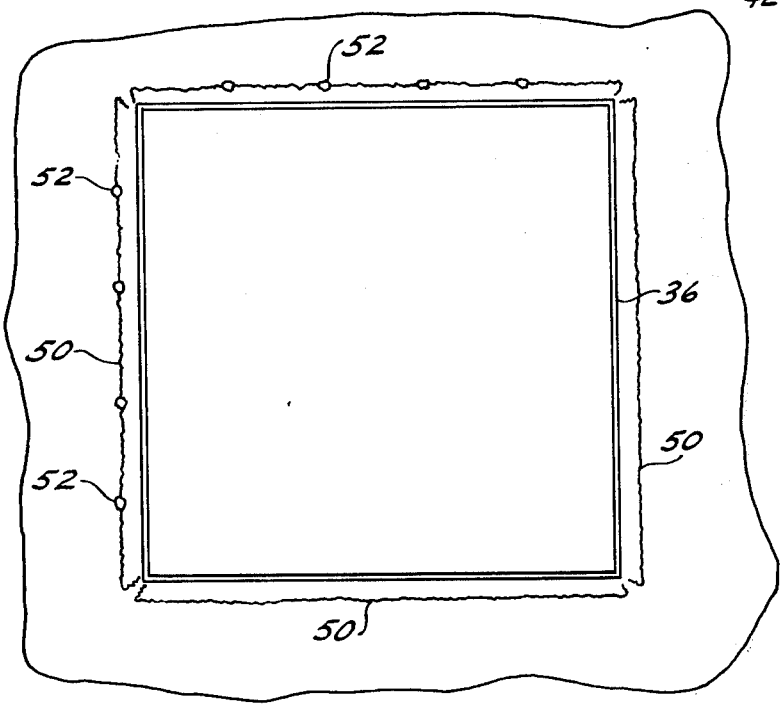
FIG. 6 is a plan view, in enlarged scale, showing the operations pad and illustrating the deformation pattern of the native ice during construction of the ice island.

As is shown most clearly in FIGS. 4, 5, and 6, construction of the ice island 10 begins by constructing a dike 36 on the native ice 16, in this case sea ice. The dike 36 outlines and encloses a confined area 38 corresponding in shape and size to the base of the operations pad 18. Similarly, a pair of spaced concentric annular dikes 40 and 40' form a confined area 42 on the sea ice 16 corresponding to the base of the containment barrier 28. Where the relief pad 34 is to be constructed, the annular dike 40 is adjusted to outline the base of the relief pad.

The dikes 36, 40 and 40' are constructed of any suitable material which is relatively water impermeable. For example, snow, which will absorb water when contacted thereby and freeze into a relatively low porosity mass, makes an ideal material since it is readily available and does not have to be transported to the site. The snow is scraped from the ice surface and piled into dikes of desired size and configuration. Other materials such as water impregnated cheesecloth, ice blocks and the like, can be used with equally good results in the construction of the dikes.

Having constructed the dikes 36, 40 and 40', ice is accumulated within the confined areas 38 and 42 by any of several methods including the introduction of already formed ice in crushed or block form. However, since the ice island 10 is constructed during the winter months when the ambient temperature is below the freezing point of water, the ice is preferably accumulated by spraying or flooding the confined areas 38 and 42 with fresh water or seawater. Fresh water, if available, is preferred since the resulting ice is of somewhat greater strength and freezes at a higher temperature. However, seawater is more generally available at offshore work sites and is used with excellent results.

The water is deposited by spraying or flooding the ice surface within the confined areas 28 and 42 to a depth of about 2 inches to about 6 inches, whereupon the water layer is permitted to freeze to form an ice layer 44. Additional layers 44 of ice are accumulated by intermittent spraying or flooding followed by freezing. This will result in a net ice accumulation generally of between about 2 inches and 5 inches or more per day of operation at a site where the average temperature is between about 0° F. and −30° F., and wind velocity is between 0 and about 20 mph. Typically accumulations of between about 2 inches and about 3 inches per day will be achieved.

As is schematically illustrated in FIGS. 5 and 6, the mass of the body formed by the accumulated ice layers 44 is substantially uniformly distributed over the underlying ice of the confined areas 38 and 42 and causes the native ice within and adjacent to the confined areas to be deformed downwardly with respect to the surface of the surrounding native ice. This is often accompanied by surface cracks 50 which are typically spaced outwardly from and run parallel to the periphery of the respective confined areas 38 and 42. Eventually a substantial portion of the ice within the confined areas 38 and 42, which ice defines the base ice of the operation pad 18 and the containment barrier 28 respectively, becomes grounded on the marine bottom 14. Ice layers 44 accumulated after the base ice has been grounded serve to elevate the upper surfaces of the body defining the operations pad 18 and the containment barrier 28 above the surface of the surrounding ice. Portions 16' of the native ice adjacent the now grounded base ice are angularly disposed with respect to the surrounding native ice and the grounded base ice, thus forming a depressed area 51 at the surface of the ice island adjacent the periphery of the operations pad 18 and the containment barrier 28. Preferably these depressed areas 51 are flooded periodically to build up the depressed areas to the level of the surrounding ice. In addition, depending upon the original height of the dikes 36, 40 and 40', it may be necessary to add snow to increase the height of the dikes from time to time as the mass of the ice layers 44 causes the ice underlying and adjacent to the ice layers to settle downwardly.

In those cases where the ice island is constructed on less flexible ice, such as for example ice formed from fresh or low brine content water or ice formed during extremely cold weather, it is preferred to weaken the ice, as by drilling stress risers 52 adjacent the periphery of the confined areas 38 and 42, as an aid in causing the ice to deform or perhaps even to shear away from the adjacent ice. The spacing of the stress risers 52 from the dikes 36, 40 and 40' is not critical although as shown, the stress risers may be located along the crack 50.

Having formed the operations pad 18 and the containment barrier 28, the ice island 10 is ready for operations.

In the preferred embodiment, an insulative platform is disposed over the work support surface 24 of the operations pad 18 prior to the installation of equipment on the operations pad to protect the upper operations surface 24.

Figure 7:
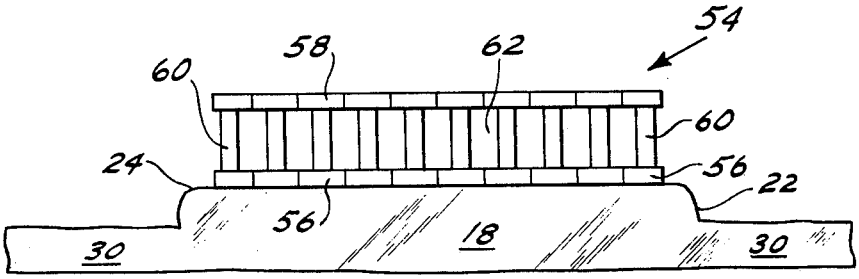
FIG. 7 is an enlarged side elevation of the upper surface of the operations pad illustrating an insulative platform therefor.

As is shown most clearly in FIG. 7, an insulative platform, illustrated generally as 54, comprising a lower deck 56 and an upper deck 58 separated by the plurality of spaced apart supporting members 60 is disposed on the upper surface 24 of the operations pad 18. The lower deck 56 and upper deck 58 are constructed of wooden planks or other suitable insulative material, and the supporting members 60 define therebetween through-running, open-ended channels 62. The platform 54 is preferably aligned on the operations pad 18 with the channels 62 lying parallel to the direction of the prevailing wind. Heat generated by work operations, solar heating, or the like, which may be conducted through the upper deck 58 is dissipated by the circulation of the air through the open-ended channels 62.

An important feature of the ice island 10 resides in the upper and lower containment basins, 32 and 33, and in their ability to contain accidental oil spills as a result of well malfunctions. The spilled oil can be recovered for subsequent refining or disposal by a suitable method.

Figure 8:
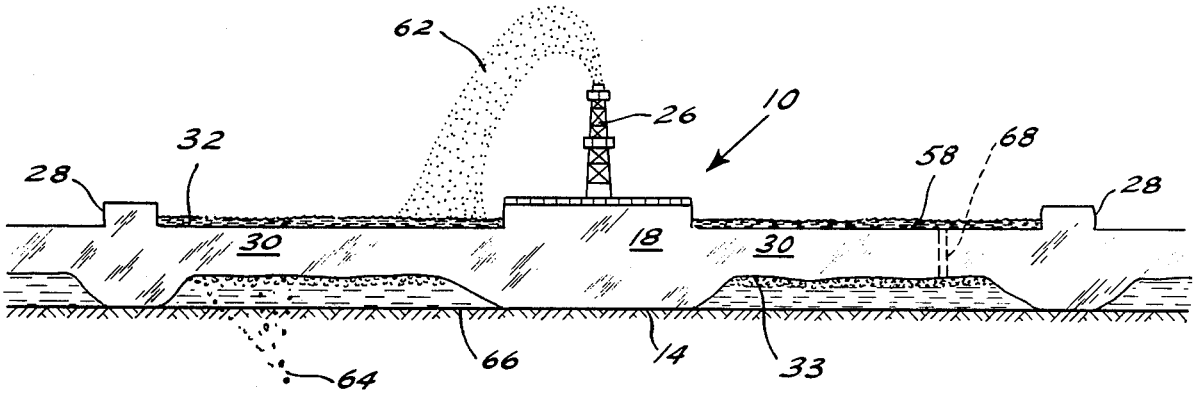
FIG. 8 is a cross-sectional view of an ice island similar to that shown in FIG. 1 illustrating the entrapment of escaping formation fluids.

As is more particularly shown in FIG. 8, the ice island 10 is shown engaged in a drilling operation. Two well malfunctions, which would not necessarily occur simultaneously; a well blowout, shown schematically as a geyser of formation fluids 62, and a fluid seep, shown schematically at 64, result in the escape of fluid from the formation. The upper containment basin 32 formed by the raised portion of containment barrier 28 and the upper surface of the interconnecting floating layer of ice 30 contains the fluids deposited by the geyser 62 and prevents their escape onto the surrounding ice. Similarly, the lower containment basin traps the seeping fluids 64, which are lighter than water, and prevents their dispersal into the water surrounding the island 10. The seawater displaced by the seeping fluids 64 passes into the surrounding water under and through the base 31 of the containment barrier 28, which is sufficiently porous to permit the passage of the displaced seawater. The fluids held by the lower containment basin 33 are recovered by drilling a bore 68 through the ice 30 and pumping out the fluids for subsequent refining or disposal.

In the case of the well blowout, a second drilling rig may be supported by the relief pad 34 to drill a second well to relieve the excess of pressure causing the well blowout or to seal the main well. As previously mentioned, the relief pad 34 is preferably located upwind of the drilling rig 26 so that the issuing formation fluids are prevented as much as possible by the prevailing winds from reaching the relief pad.

In addition to aiding in the entrapment of accidentally spilled formation fluids, the containment barrier 28 also serves to protect the operations pad 18 against the action of shifting ice. The containment barrier 28 provides a high surface area for distributing the stress of the moving ice and also serves as an energy absorbing cushion.

Figure 9:
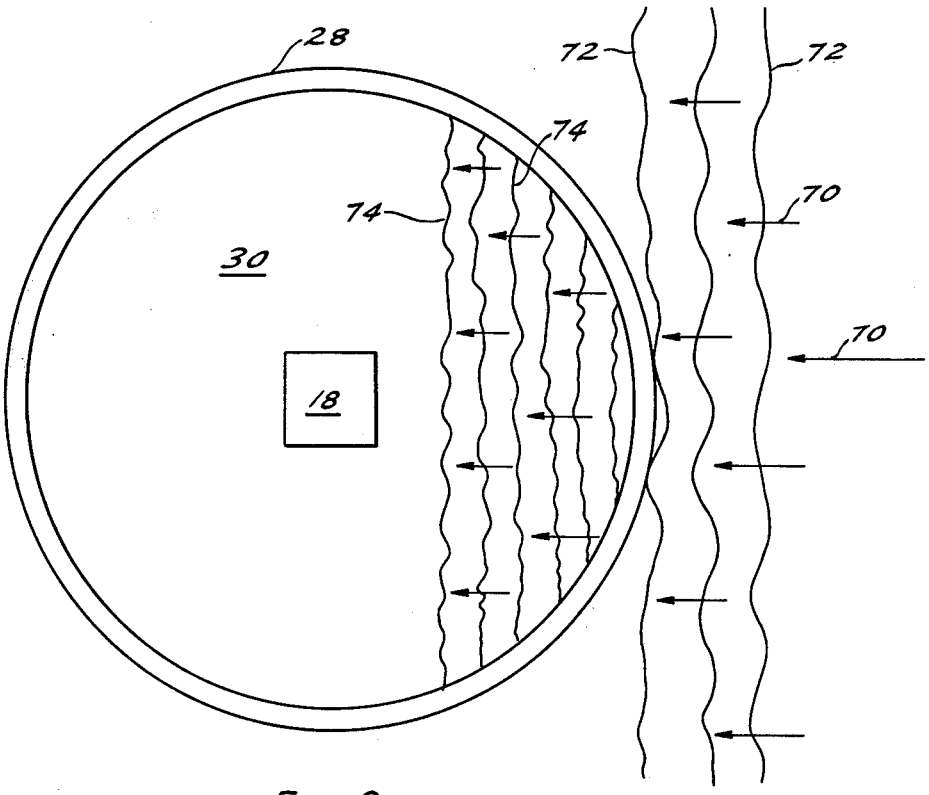
FIG. 9 is a schematic plan view of an ice island similar to that shown in FIG. 1 and illustrating stress imposed thereon by shifting native ice.

As is most clearly shown in FIG. 9, the containment barrier 28 surrounding the operations pad 18 and interconnected thereto by the ice layer 30, is subjected to stress from the movement of pack ice, illustrated schematically by arrows 70 and heave lines 72. The force is imposed against the large surface area of the containment barrier 28 rather than being concentrated on the operations pad 18. In the event the force imposed by the shifting ice exceeds the strength of the containment barrier 28, it will begin to collapse inwardly against the connecting layer of ice 30 which is caused to crack and buckle, as schematically illustrated by lines 74. The buckling of the connecting ice 30 absorbs additional energy imposed by the shifting ice and serves as a visual indication of the stress being imposed on the containment barrier. Stress relief can be accomplished by periodic removal of the buckled ice 30 in situations where the ice shift imposing the stress is not too great.

The following example illustrates an embodiment of the ice island and the method for its construction in accordance with the present invention.

EXAMPLE

A construction site is located in the Beaufort Sea, North Slope Basin, Alaska, for the construction of an ice island. Water depth at the construction site is about 9 feet. Construction is initiated in the fall of the year and the construction site is covered with a layer of fast ice ranging in thickness from between about 1 foot and 2 feet. This is sufficient thickness to support the construction crew and their vehicles.

Snow is scraped from the ice surface and arranged in a substantially rectangular configuration to define a confined area 200 feet by 360 feet which corresponds to the base of the operations pad. A pair of concentric, generally circular dikes are prepared from snow with the innermost dike having a diameter of about 900 feet and the outermost annular dike having a diameter of about 1040 feet. The confined annular area between the dikes corresponds to the base of the containment barrier and is about 50 feet in width. A hole is drilled through the ice adjacent each of the confined areas and a low-head high-volume pump is located at each of the holes to pump sea water into the confined areas within the dikes. Pumping, which is conducted at a delivery rate of about 45,000 gph, per pump, is continued until the confined areas are flooded with a layer of seawater of between about 2 and about 6 inches in thickness. At this point pumping is discontinued and the seawater layer allowed to freeze. When the water layer is frozen, pumping is reinstituted to deposit a second water layer over the now frozen first layer. Intermittent pumping and freezing is continued for 59 days, during which period the average ambient temperature is −24° F. and the winds average 5 mph.

By the 59th day the rectangular operations pad and the annular containment barrier is grounded on the bottom and their upper surfaces are elevated above the surface of the surrounding fast ice a distance of about 3 feet, making the total thickness of the containment barrier and the operations pad about 12 feet.

Various embodiments and modifications of this invention have been described in the foregoing description and example, and further modifications will be apparent to those skilled in the art. Such modifications are included within the scope of this invention as defined by the following claims.

Having now described the invention, I claim:

1. An ice island for conducting offshore operations in a frigid environment, said ice island comprising:

an ice mass defining an operations pad, the base thereof being supported on the marine bottom at a desired operations site;

an ice structure defining a containment barrier surrounding said operations pad and spaced outwardly therefrom, the base of said containment barrier being also supported on the marine bottom;

a layer of ice disposed in the space between said operations pad and said containment barrier, the undersurface of said layer of ice being spaced above the marine bottom and being unsupported thereby and upper and lower containment basins defined by the upper and under surfaces of said layer of ice and said containment barrier.

2. The ice island of claim 1 wherein the upper surface of said operations pad extends above the upper surface of said ice layer to define an elevated operations support surface.

3. The ice island of claim 1 wherein the upper surface of said containment barrier extends above the surface of said ice layer.

4. The ice island of claim 1 further including a relief pad formed integrally with said containment barrier along a portion of the periphery thereof, the base of said relief pad being supported on the marine bottom.

5. The ice island of claim 4 wherein said relief pad is oriented with respect to said operations pad in the direction of the prevailing wind.

6. The ice island of claim 1 wherein said operations pad is rectangular in plan configuration and said containment barrier is circular in plan configuration, said operations pad being substantially centrally located within said containment barrier.

7. An ice island for conducting offshore operations in a frigid environment, said ice island comprising:

an ice body defining an operations pad having its base grounded on the marine bottom and its upper surface elevated above the level of surrounding native ice to define a raised operations support surface;

an ice body defining a containment barrier surrounding said operations pad and spaced outwardly therefrom, the base of said containment barrier being grounded on the marine bottom and its upper surface elevated above the level of surrounding native ice, a portion of the periphery of said containment barrier being enlarged to define a relief operations support pad;

a layer of ice disposed in the space between said operations pad and said containment barrier, the under surface thereof being unsupported by said marine bottom; and upper and lower containment basins defined by the upper and under surfaces of said layer of ice and said containment barrier.

8. A method for the construction of a grounded ice island at a frigid offshore location in waters covered by a sheet of floating native ice, said ice island including a central operations pad and a surrounding containment barrier spaced outwardly therefrom, the method comprising:

forming on the surface of said native ice a first confined area corresponding in shape and size to said operations pad base and forming a second confined area corresponding in shape and size to the base of said containment barrier, and the total area of said confined areas being less than the total area of said native ice overlying said location;

accumulating ice within each of said confined areas, to form therein ice bodies of sufficient mass to cause said ice in each of said confined areas to settle to the marine bottom and to be supported thereon;

the area confined within the base of said containment barrier and the undersurface of said native ice defining an upper containment basin;

continuing said accumulation of ice to build the upper surface of said operations pad and said containment barrier above the surface of said native ice thereby to define an upper containment basin.

9. The method of claim 8 wherein said ice is accumulated by intermittently depositing water in each of said confined areas under ambient conditions such that said water freezes into a layer of ice between deposits.

10. The method of claim 9 wherein said water is deposited in each of said confined areas by flooding said areas to a depth of between about 2 inches and about 6 inches.

11. The method of claim 8 wherein said operations pad is accumulated until the upper surfaces of said pad and said containment barrier are elevated at least about 3 feet above the surface of the native ice.

12. The method of claim 8 wherein said confined areas are defined by dikes comprising water impregnated snow which has been frozen by the ambient conditions into a substantially low porosity mass.

* * * * *

UNITED STATES PATENT AND TRADEMARK OFFICE

CERTIFICATE OF CORRECTION

PATENT NO. : 4,048,808

DATED : September 20, 1977

INVENTOR(S) : FREDERICK C. DUTHWEILER

It is certified that error appears in the above-identified patent and that said Letters Patent are hereby corrected as shown below:

In column 7, claim 1, line 20 after the word "thereby" should be --;--.

In column 8, claim 8, line 31 "an upper" should be corrected to read --a lower--.

In column 8, claim 11, line 44, "operations pad" should be corrected to read --ice--; and line 45 after the word "said" the word --operations-- should be inserted.

In the references cited, the 9th reference listed, the inventor's name should be --Poche-- instead of Pocme.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademark.*